US010750919B2

(12) United States Patent
Luo

(10) Patent No.: US 10,750,919 B2
(45) Date of Patent: Aug. 25, 2020

(54) CLEANING MACHINE AND PATH CONTROL METHOD THEREFOR

(71) Applicant: Jichuan Luo, Hengyang (CN)

(72) Inventor: Jichuan Luo, Hengyang (CN)

( * ) Notice: Subject to any disclaimer, the term of this patent is extended or adjusted under 35 U.S.C. 154(b) by 242 days.

(21) Appl. No.: 16/016,911

(22) Filed: Jun. 25, 2018

(65) Prior Publication Data

US 2019/0191950 A1 Jun. 27, 2019

(30) Foreign Application Priority Data

Dec. 21, 2017 (CN) ..... 2017 1 1399134

(51) Int. Cl.

| | |
|---|---|
| ***A47L 11/14*** | (2006.01) |
| ***A47L 11/282*** | (2006.01) |
| ***A47L 1/02*** | (2006.01) |
| ***A47L 11/40*** | (2006.01) |
| ***A47L 11/283*** | (2006.01) |

(52) U.S. Cl.

CPC ..... *A47L 11/14* (2013.01); *A47L 1/02* (2013.01); *A47L 11/282* (2013.01); *A47L 11/283* (2013.01); *A47L 11/4008* (2013.01); *A47L 11/4011* (2013.01); *A47L 11/4038* (2013.01); *A47L 11/4061* (2013.01); *A47L 11/4066* (2013.01); *A47L 2201/04* (2013.01); *A47L 2201/06* (2013.01)

(58) Field of Classification Search

CPC ..... A47L 11/14; A47L 11/282; A47L 11/283; A47L 11/4008; A47L 11/4011; A47L 11/4038; A47L 11/4061; A47L 11/4066; A47L 1/02; A47L 2201/04; A47L 2201/06

See application file for complete search history.

(56) References Cited

U.S. PATENT DOCUMENTS

| | | | | |
|---|---|---|---|---|
| 2015/0190028 | A1* | 7/2015 | Yan | A47L 11/16 15/49.1 |
| 2015/0342431 | A1* | 12/2015 | Zydek | A47L 9/0477 15/366 |
| 2016/0331200 | A1* | 11/2016 | Yang | A47L 11/4069 |
| 2018/0206691 | A1* | 7/2018 | Jang | A47L 11/4066 |
| 2018/0242808 | A1* | 8/2018 | Jung | G05D 1/0227 |

(Continued)

FOREIGN PATENT DOCUMENTS

| | | | |
|---|---|---|---|
| CN | 103505140 | A * | 1/2014 |
| CN | 105615763 | A * | 6/2016 |
| CN | 106691295 | A * | 5/2017 |

(Continued)

*Primary Examiner* — Marc Carlson

(74) *Attorney, Agent, or Firm* — Notaro, Michaelos & Zaccaria P.C.

(57) ABSTRACT

A cleaning machine and path control method therefor has a main motor and fan blade unit arranged between upper and middle housings. Three groups, each including edge wheel motor, edge wheel gear set and edge wheel worm are distributed in a triangle between its middle and lower housings. When the main motor is turned on, it draws air through the fan blade unit, from between its chuck and a surface to be cleaned, with the chuck attached to the surface to be cleaned. When the edge wheel motor is turned on, it drives a cloth through the edge wheel gear set, so that friction is generated between the cleaning cloth structure and the surface to be cleaned, thereby cleaning the surface to be cleaned.

9 Claims, 9 Drawing Sheets

(56) References Cited

U.S. PATENT DOCUMENTS

2019/0033869 A1* 1/2019 Herron ..... B62D 57/02

FOREIGN PATENT DOCUMENTS

| | | | | | |
|---|---|---|---|---|---|
| CN | 106970625 | A | * | 7/2017 | |
| EP | 2888980 | A1 | * | 7/2015 | ..... A47L 11/4061 |
| KR | 20120009927 | A | * | 2/2012 | |
| WO | WO-2004073476 | A1 | * | 9/2004 | ..... A47L 11/2025 |

* cited by examiner

CLEANING MACHINE AND PATH CONTROL METHOD THEREFOR

CROSS-REFERENCE TO RELATED APPLICATIONS

The present application claims the priority of the Chinese patent application no. 201711399134.5, filed with the Chinese Patent Office on Dec. 21, 2017 and entitled "Cleaning Machine and Path Control Method therefor", which is incorporated herein by reference in its entirety.

TECHNICAL FIELD

The present invention relates to the technical field of cleaning machines, and particularly to a cleaning machine and a path control method therefor.

BACKGROUND ART

Cleaning machines, which may also be referred to as cleaning robots, deal primarily with domestic cleaning, washing and other work, e.g., cleaning the floor, wall surfaces, glass, furniture and the like. Some cleaning machines have special usages, for example, cleaning machines specified for glass cleaning, cleaning machines specified for floor sweeping, etc. However, the existing cleaning machines have relatively poor cleaning effects, e.g., being likely to leave stains or marks on the cleaned surfaces, leaving out some areas during the cleaning process, etc., which result in poor user experience.

No effective solution has been proposed for the problem that the existing cleaning machines have relatively poor cleaning effects.

DISCLOSURE OF THE INVENTION

In a first aspect, an embodiment of the present application provides a cleaning machine, comprising an upper housing, a middle housing and a lower housing, in which at least one group including a main motor and a fan blade unit matching with each other is arranged between the upper housing and the middle housing; the fan blade unit is fixedly at a bottom of the main motor, and a main control circuit board is arranged at the bottom of the fan blade unit;

Three sets of edge wheel driving structures are distributed in a form of a triangle between the middle housing and the lower housing; each set of the edge wheel driving structures comprises an edge wheel motor, an edge wheel gear set and an edge wheel worm; an output shaft of the edge wheel motor is fixedly connected with the edge wheel worm; the edge wheel worm is engaged with the edge wheel gear set; a chuck and a cleaning cloth structure are arranged outside of the lower housing; the chuck is in fluid communication with the fan blade unit; and the cleaning cloth structure is connected with the edge wheel gear set; and the main control circuit board is configured to control the turn-on or turn-off of the main motor and the edge wheel motor; when the main motor is turned on, the main motor is configured to draw, through the fan blade unit, air from between the chuck and a surface to be cleaned, with the chuck attached to the surface to be cleaned; when the edge wheel motor is turned on, the edge wheel motor is configured to drive, through the edge wheel gear set, the cleaning cloth structure to rotate, so that friction is generated between the cleaning cloth structure and the surface to be cleaned, thereby cleaning the surface to be cleaned.

In a second aspect, an embodiment of the present application provides a path control method for a cleaning machine, which method is applicable for the aforesaid cleaning machine, the cleaning machine comprising a first edge wheel gear set, a second edge wheel gear set and a third edge wheel gear set, the method comprising:

making, in an advancing direction of the cleaning machine, the second edge wheel gear set and the third edge wheel gear set being located in front of the first edge wheel gear set, and making a connection line between the second edge wheel gear set and the third edge wheel gear set perpendicular to the advancing direction;

executing, after the cleaning machine is started, straight-line movement instructions of: commanding the first edge wheel gear set and the second edge wheel gear set to simultaneously rotate clockwise by a first preset angle, and commanding the first edge wheel gear set and the third edge wheel gear set to simultaneously rotate counterclockwise by the first preset angle, in which the straight-line movement instructions are continuously executed until a turning instruction is received; alternatively, executing straight-line movement instructions of: commanding the first edge wheel gear set and the second edge wheel gear set to simultaneously rotate counterclockwise by a first preset angle, and commanding the first edge wheel gear set and the third edge wheel gear set to simultaneously rotate clockwise by the first preset angle, in which the straight-line movement instructions are continuously executed until a turning instruction is received; alternatively, executing straight-line movement instructions of: commanding the first edge wheel gear set to be fixed and the second edge wheel gear set and the third edge wheel gear set to simultaneously rotate clockwise by a first preset angle, commanding the third edge wheel gear set to be fixed and the first edge wheel gear set and the second edge wheel gear set to simultaneously rotate clockwise by the first preset angle, and commanding the second edge wheel gear set to be fixed and the first edge wheel gear set and the third edge wheel gear set to simultaneously rotate clockwise by the first preset angle; alternatively, executing straight-line movement instructions of: commanding the first edge wheel gear set to be fixed and the second edge wheel gear set and the third edge wheel gear set to simultaneously rotate counterclockwise by a first preset angle, commanding the third edge wheel gear set to be fixed and the first edge wheel gear set and the second edge wheel gear set to simultaneously rotate counterclockwise by the first preset angle, and commanding the second edge wheel gear set to be fixed and the first edge wheel gear set and the third edge wheel gear set to simultaneously rotate counterclockwise by the first preset angle;

executing, after the turning instruction is received, turning operations of: commanding the first edge wheel gear set and the second edge wheel gear set to simultaneously rotate clockwise by a second preset angle, or commanding the first edge wheel gear set and the third edge wheel gear set to simultaneously rotate clockwise by the second preset angle; alternatively, commanding the first edge wheel gear set and the second edge wheel gear set to simultaneously rotate counterclockwise by a second preset angle, or commanding the first edge wheel gear set and the third edge wheel gear set to simultaneously rotate counterclockwise by the second preset angle, wherein the second preset angle is greater than the first preset angle; and executing, after a turn-around instruction is received, turn-around operations of: commanding the first edge wheel gear set and the third edge wheel gear set to simultaneously rotate clockwise by the first preset angle, in a case where the turn-around instruction is received after the first edge wheel gear set and the second edge wheel gear set have simultaneously rotated clockwise by the first preset angle; and commanding the first edge wheel gear set and the second edge wheel gear set to simultaneously rotate counterclockwise by the first preset angle, in a case where the turn-around instruction is received after the first edge wheel gear set and the third edge wheel gear set have simultaneously rotated counterclockwise by the first preset angle.

BRIEF DESCRIPTION OF DRAWINGS

Other features and advantages of the present application will be set forth in the following description, or some of the features and advantages may be inferred or unambiguously determined from the description or may be known by implementing the above techniques of the present application.

In order to make it easier to understand the objectives, features and advantages of the present application, detailed description is made below in connection with preferred embodiments with reference to the accompanying drawings.

In order to more clearly illustrate the technical solutions of the embodiments of the present application or in the prior art, brief description is made below on the drawings required to be used in the description of the optional embodiments or the prior art. Obviously, the drawings described below illustrate some of the embodiments of the present application, and for those of ordinary skills in the art, other drawings may be obtained from these drawings without inventive efforts.

Figure 1:
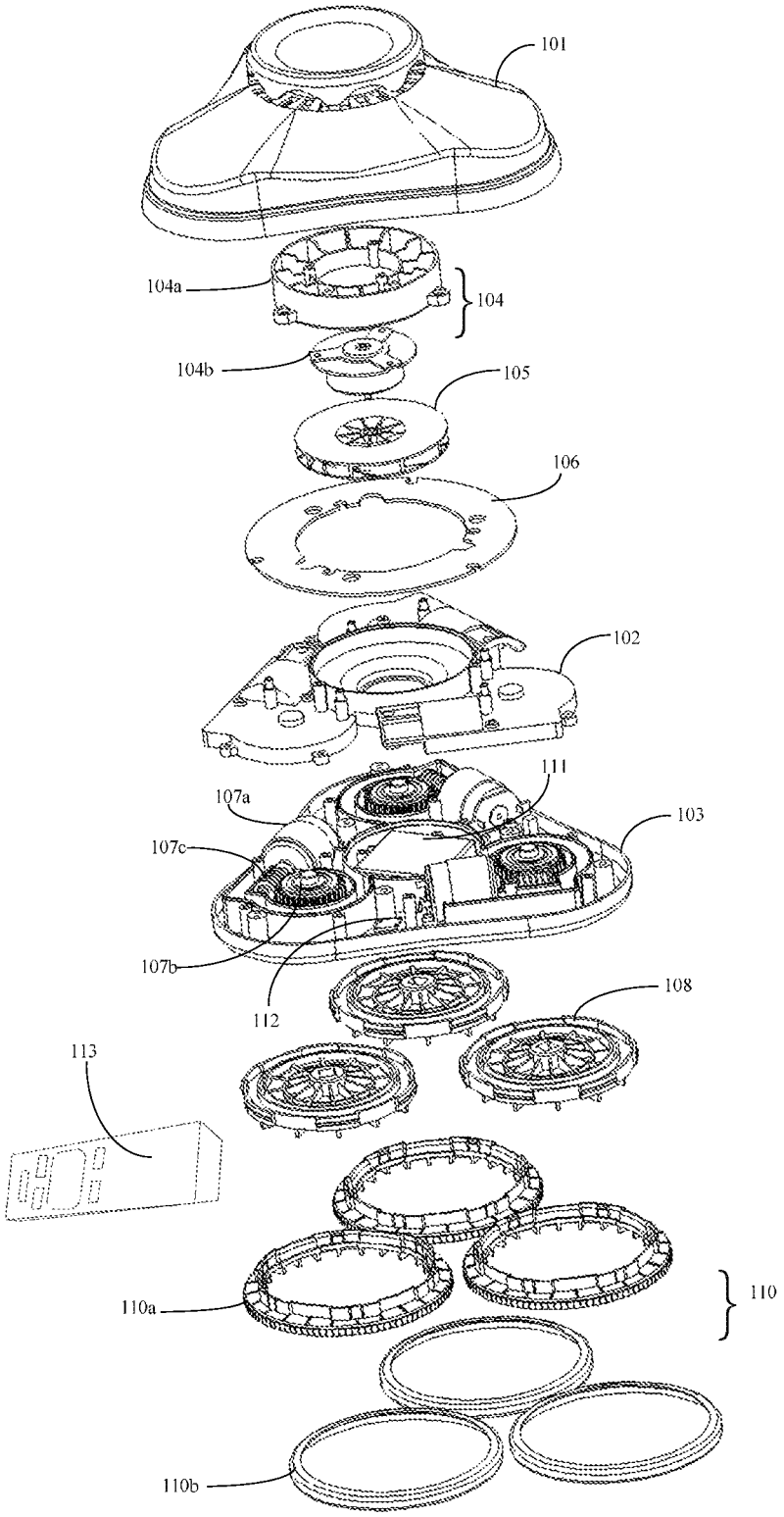
Figure 2:
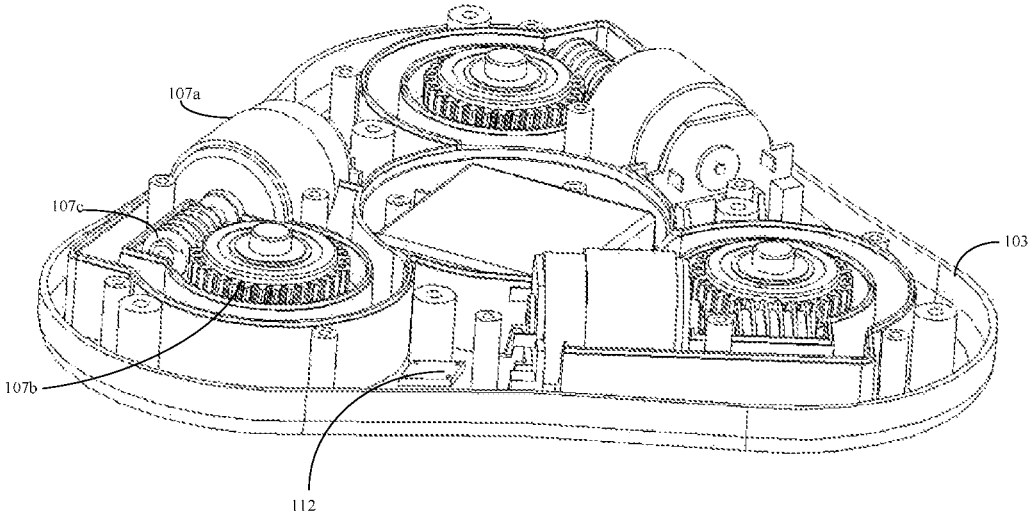
Figure 3:
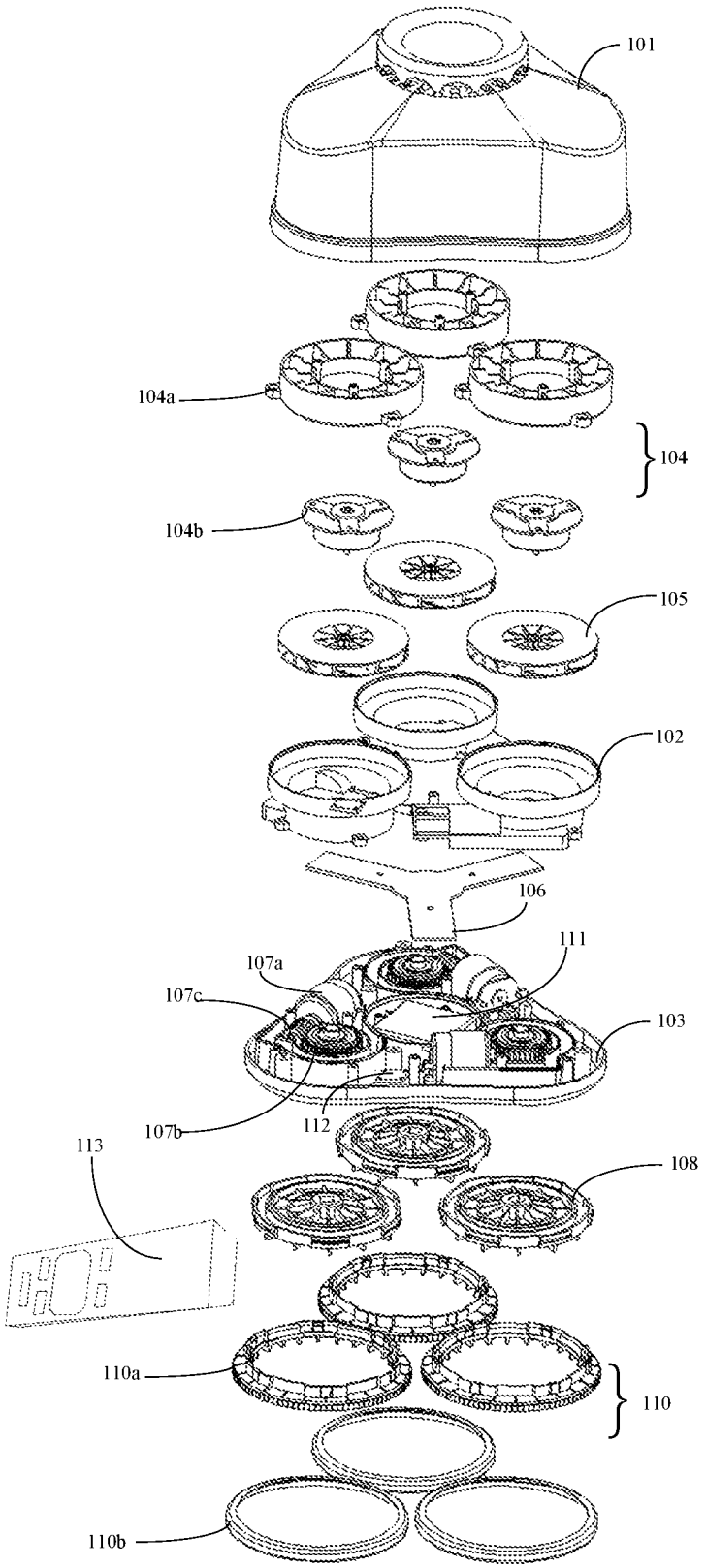
Figure 4:
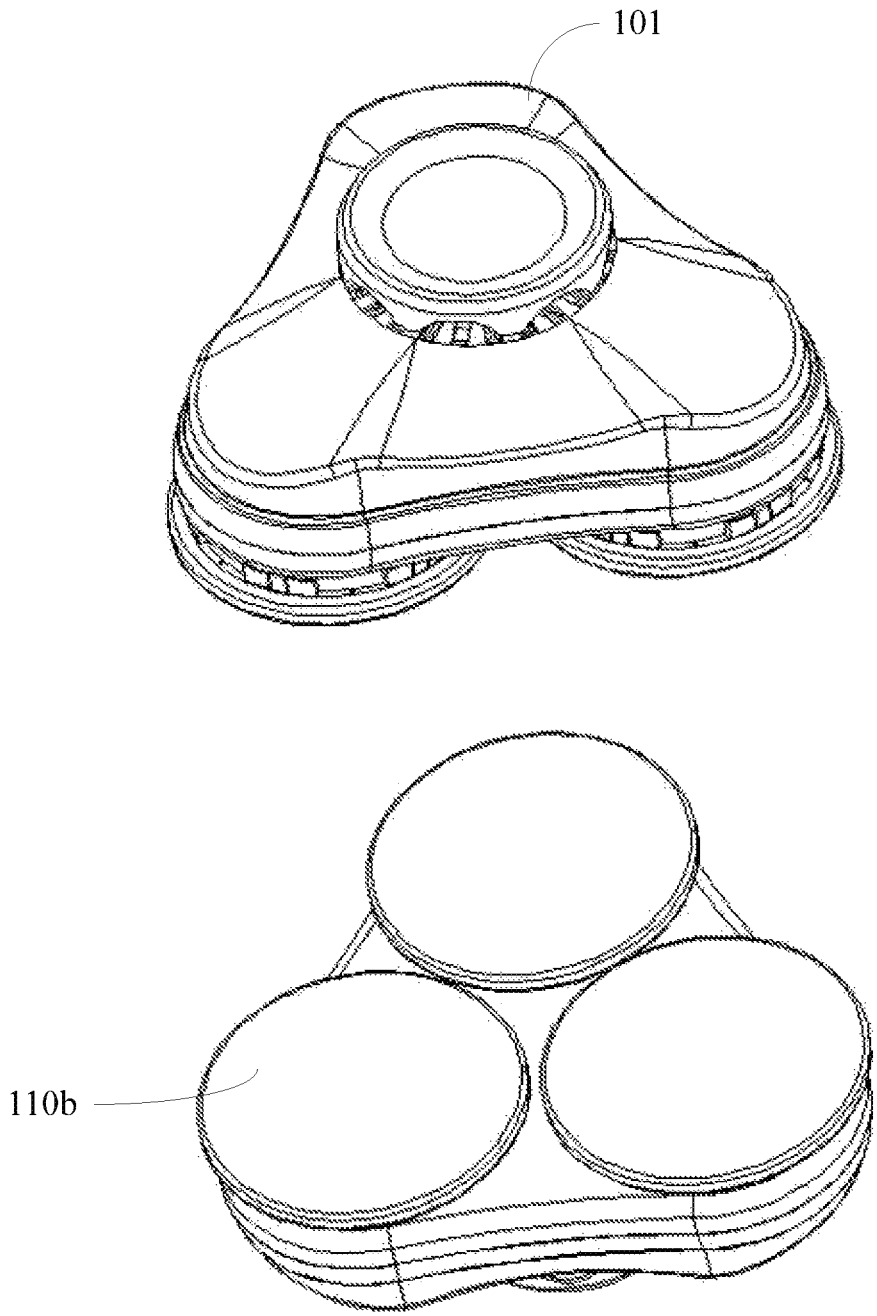
Figure 5:
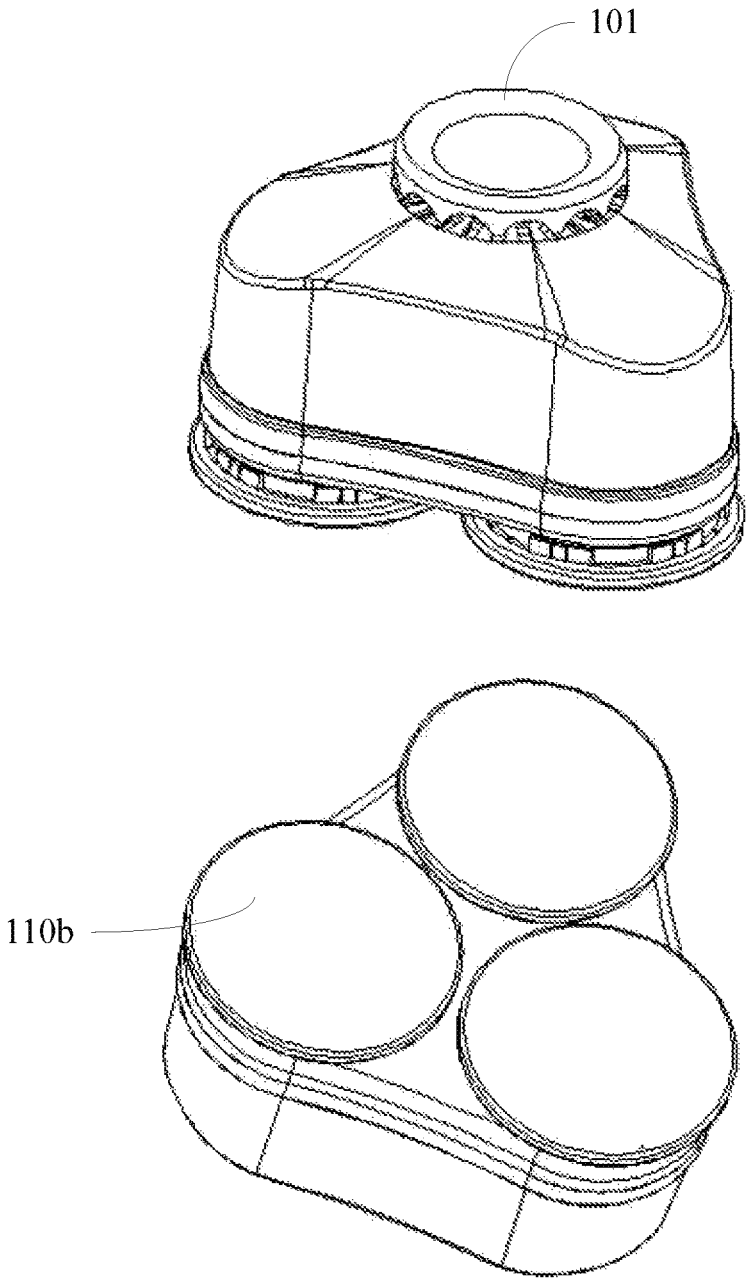
Figure 6:
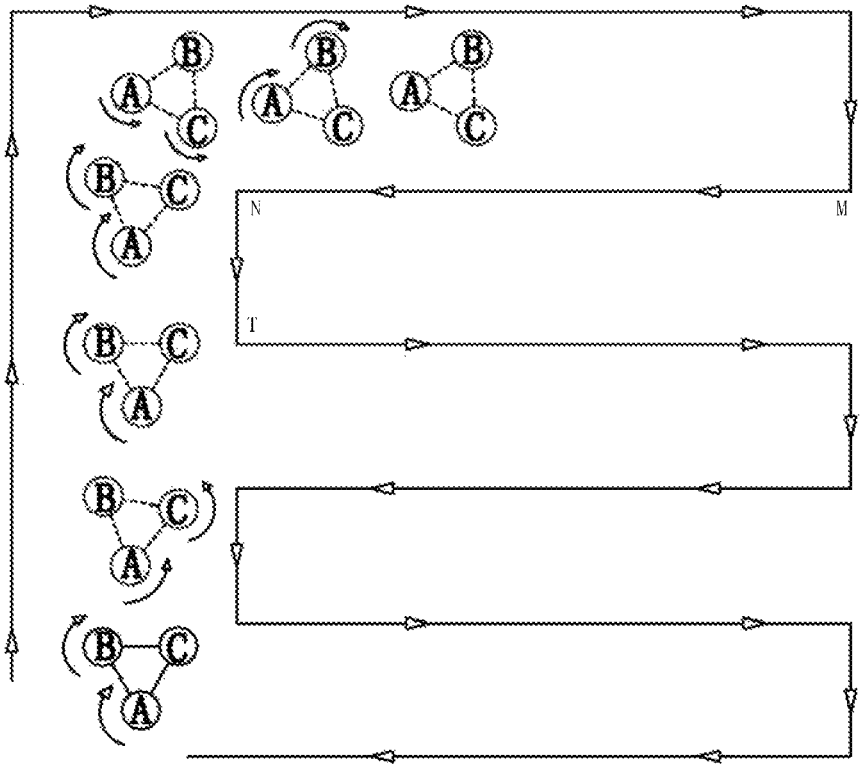
Figure 7:
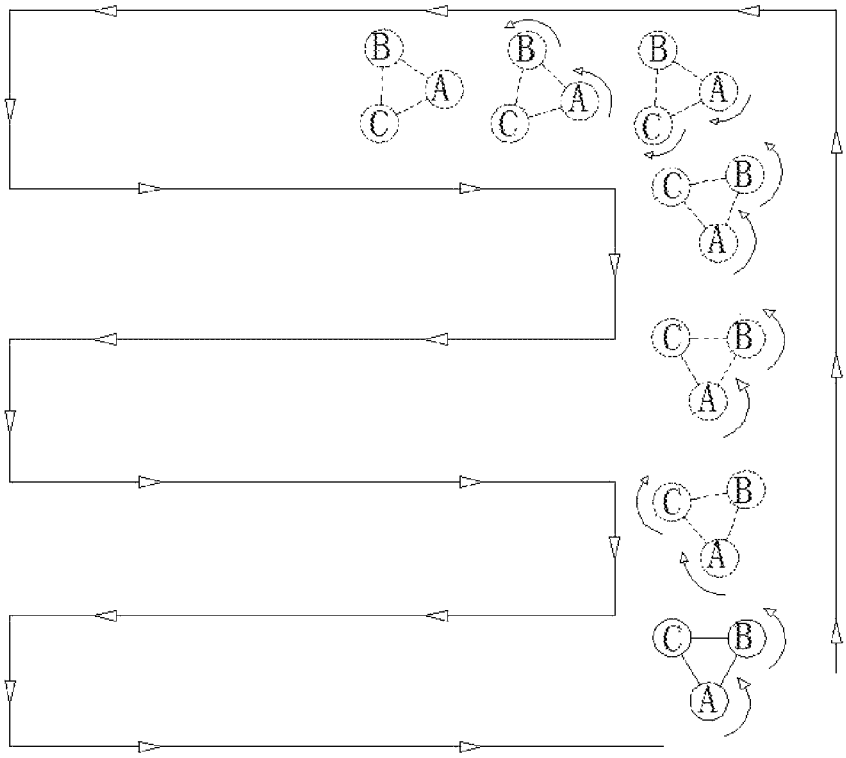
Figure 8:
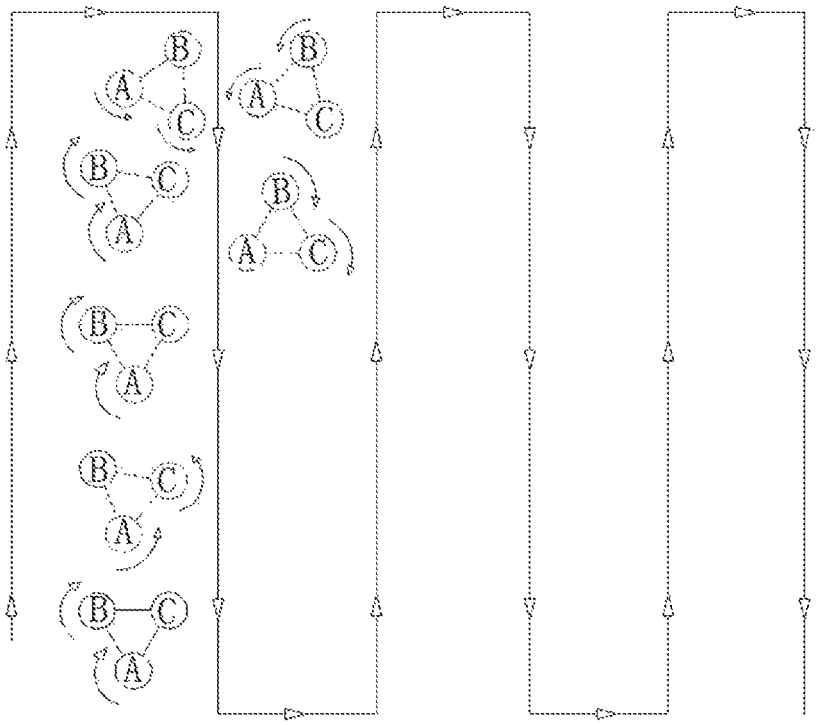
Figure 9:
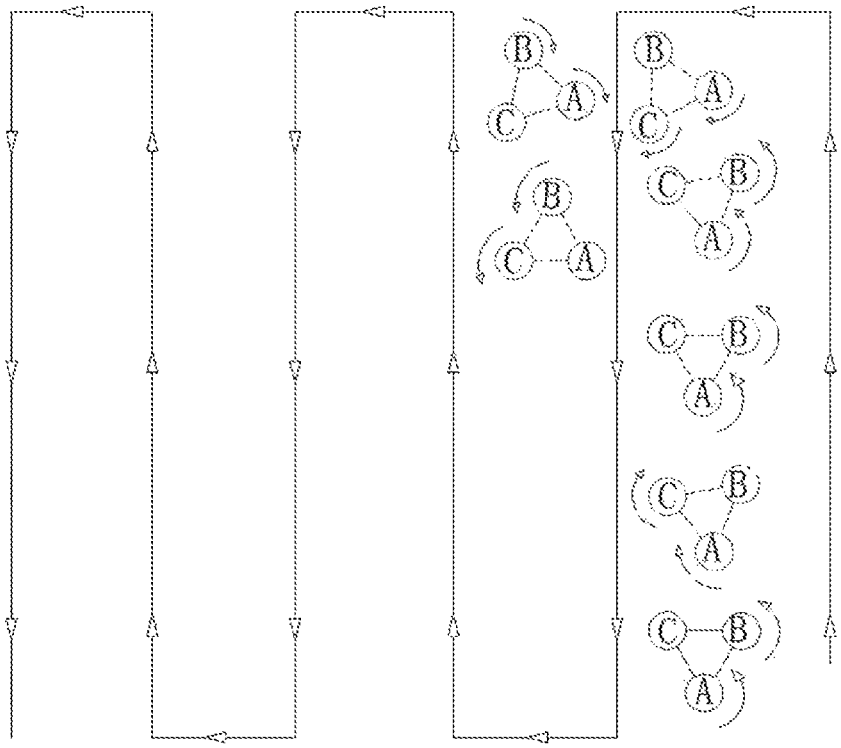
Figure 10:
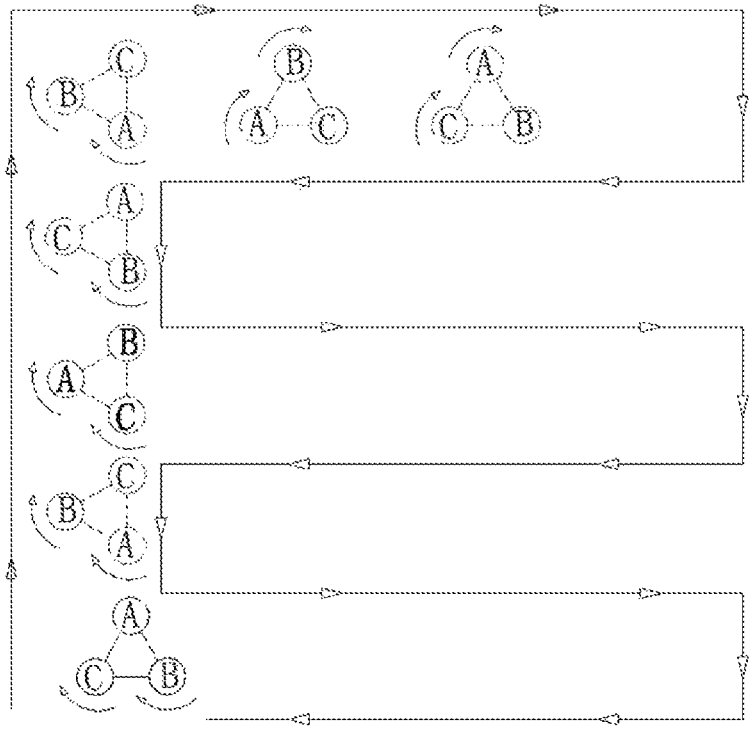
Figure 11:
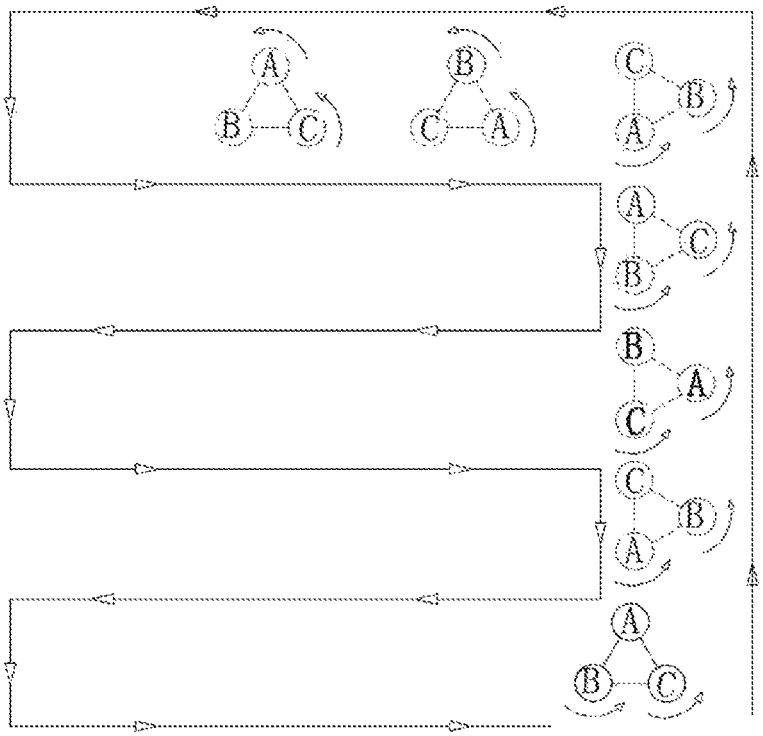
Figure 12:
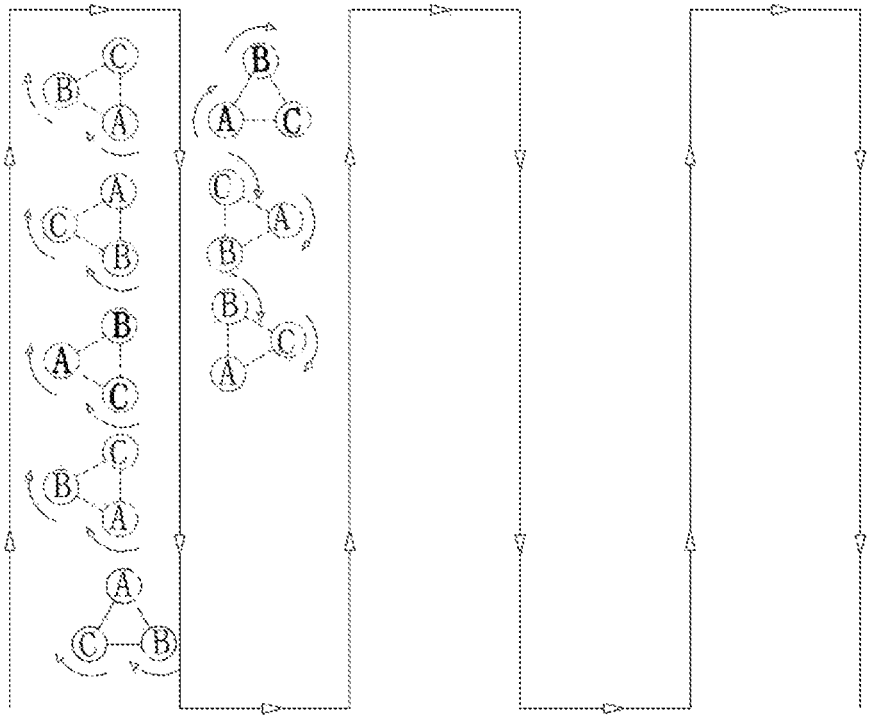
Figure 13:
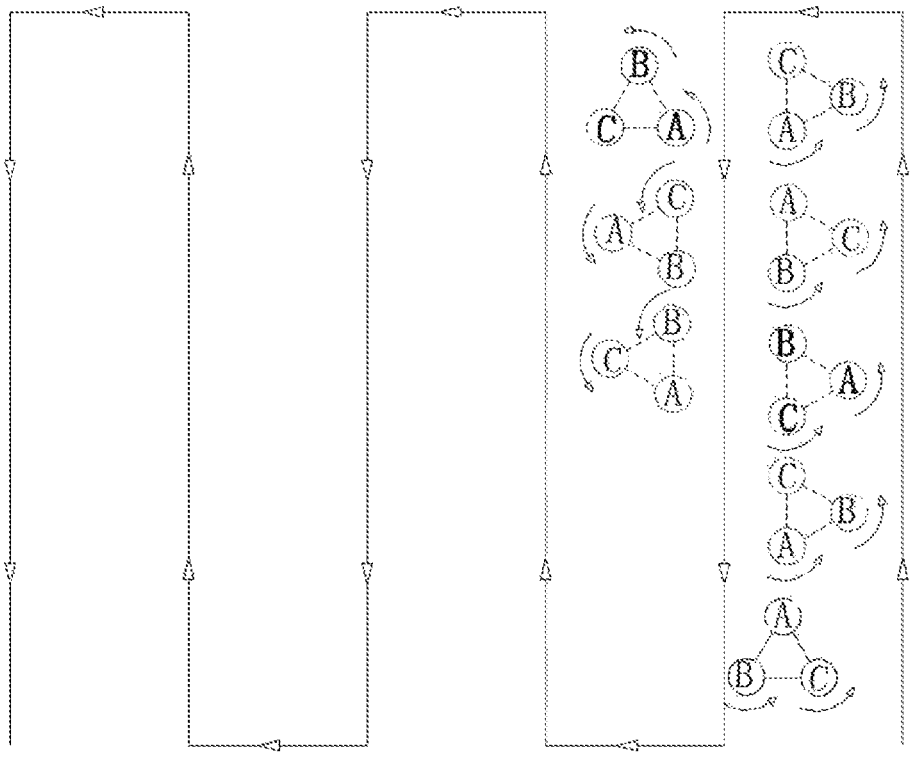

FIG. 1 is a structural exploded view of a cleaning machine provided by an embodiment of the present application;

FIG. 2 is a schematic diagram of an optional structure of an edge wheel driving structure in a cleaning machine provided by an embodiment of the present application;

FIG. 3 is a structural exploded view of another cleaning machine provided by an embodiment of the present application;

FIG. 4 is a schematic diagram of an external structure of a cleaning machine provided by an embodiment of the present application;

FIG. 5 is a schematic diagram of another external structure of a cleaning machine provided by an embodiment of the present application;

FIG. 6 is a schematic diagram of a movement path for a cleaning machine provided by an embodiment of the present application;

FIG. 7 is a schematic diagram of another movement path for a cleaning machine provided by an embodiment of the present application;

FIG. 8 is a schematic diagram of another cleaning machine movement path for a cleaning machine provided by an embodiment of the present application;

FIG. 9 is a schematic diagram of another movement path for a cleaning machine provided by an embodiment of the present application;

FIG. 10 is a schematic diagram of another movement path for a cleaning machine provided by an embodiment of the present application;

FIG. 11 is a schematic diagram of another movement path for a cleaning machine provided by an embodiment of the present application;

FIG. 12 is a schematic diagram of another movement path for a cleaning machine provided by an embodiment of the present application; and FIG. 13 is a schematic diagram of another movement path for a cleaning machine provided by an embodiment of the present application.

REFERENCE NUMERALS

101—upper housing; 102—middle housing; 103—lower housing; 104—main motor; 105—fan blade unit; 106—main control circuit board; 107*a*—edge wheel motor; 107*b*—edge wheel gear set; 107*c*—edge wheel worm; 108—chuck; 110—cleaning cloth structure; 104*a*—main motor support; 104*b*—main motor body; 110*a*—cleaning cloth support; 110*b*—cleaning cloth; 111—battery pack; 112—remote control receiving board; and 113—remote controller.

DETAILED DESCRIPTION OF EMBODIMENTS

In order to make the objectives, technical solutions and advantages of the embodiments of the present application clearer, the technical solutions of the present application will be described clearly and completely below with reference to the drawings. Apparently, the embodiments described are some of the embodiments of the present application, rather than all of the embodiments. All the other embodiments that are obtained by those of ordinary skills in the art on the basis of the embodiments of the present application without inventive effort shall be covered by the scope of protection of the present application.

In view of the problem that the existing cleaning machines have relatively poor cleaning effects, the embodiments of the present application provide a cleaning machine and a path control method therefor. The technique can be applied to the cleaning of glass surfaces, floor, wall surfaces and furniture surfaces, especially in the cleaning of the surfaces inclined at various angles. The technique may be implemented by using relevant software or hardware. Description is made below with embodiments.

Referring to the structural exploded view of a cleaning machine in FIG. 1, the cleaning machine comprises an upper housing 101, a middle housing 102 and a lower housing 103. At least one group including a main motor 104 and a fan blade unit 105 matching with each other is arranged between the upper housing 101 and the middle housing 102, the fan blade unit 105 is fixedly at the bottom of the main motor 104, and a main control circuit board 106 is arranged at the bottom of the fan blade unit 105.

Three sets of edge wheel driving structures are distributed in a form of a triangle between the middle housing 102 and the lower housing 103; each set of the edge wheel driving structures comprises an edge wheel motor 107*a*, an edge wheel gear set 107*b* and an edge wheel worm 107*c*. Referring to the schematic diagram of an optional structure for an edge wheel driving structure in a cleaning machine in FIG. 2, as can be seen from FIG. 2, an output shaft of the edge wheel motor 107*a* is fixedly connected with the edge wheel worm 107*c*, and the edge wheel worm 107*c* is engaged with the edge wheel gear set 107*b*.

In FIG. 2, the edge wheel gear set 107*b* in the edge wheel driving structure is arranged at a vertex position of the aforesaid triangle, and the edge wheel motor 107*a* is arranged at a position on the connection line of the triangle; each set of the edge wheel motor 107*a* and the edge wheel gear set 107*b* is connected through the edge wheel worm 107*c*. The cleaning machine as shown in FIG. 2 comprises three sets of the edge wheel driving structures, and the three sets of edge wheel motors and the three sets of edge wheel gear sets in the three sets of the edge wheel driving structures are arranged to be spaced apart from one another.

As shown in FIG. 1, a chuck 108 and a cleaning cloth structure 110 are arranged outside of the lower housing 103, and the chuck 108 is in fluid communication with the fan blade unit 105, and the cleaning cloth structure 110 is connected with the edge wheel gear set 107*b*.

In the present embodiment, the main control circuit board 106 is configured to control the turn-on or turn-off of the main motor 104 and the edge wheel motor 107*a*; when the main motor 104 is turned on, the main motor 104 is configured to draw, through the fan blade unit 105, air from between the chuck 108 and a surface to be cleaned, with the chuck 108 attached to the surface to be cleaned; when the edge wheel motor 107*a* is turned on, the edge wheel motor 107*a* is configured to drive, through the edge wheel gear set 107*b*, the cleaning cloth structure 110 to rotate, so that friction is generated between the cleaning cloth structure 110 and the surface to be cleaned, thereby cleaning the surface to be cleaned. The surface to be cleaned may be the floor or a glass surface, which is not specifically defined in the present embodiment.

The main control circuit board is typically provided with a control chip, for example, a single-chip microcomputer, a DSP (digital signal processing) chip, a PLC (programmable logic controller), an FPGA (field programmable gate array), an ASIC (application specific integrated circuit), etc.

Specifically, when the surface to be cleaned forms a certain angle with a horizontal surface, or is a horizontal surface facing downward, the main motor drives the fan blade unit to rotate to draw away air from between the chuck 108 and the surface to be cleaned, such that a negative pressure is generated between the chuck 108 and the surface to be cleaned. As a result, under the action of atmospheric pressure, the chuck 108 is tightly attached to the surface to be cleaned, and thereby the cleaning machine is fixed on the surface to be cleaned.

When the edge wheel motor 107*a* is turned on, the edge wheel motor 107*a* is configured to drive, through the edge wheel gear set 107*b*, the cleaning cloth structure 110 to rotate, so that friction is generated between the cleaning cloth structure 110 and the surface to be cleaned, thereby cleaning the surface to be cleaned.

Specifically, when deep cleaning is performed on the surface to be cleaned, it is generally required that a relatively great friction force is generated between the cleaning cloth structure and the surface to be cleaned. At this time, even if the surface to be cleaned is a horizontal surface, it is still necessary to cause the chuck to produce a suction force through the main motor, so that a pressure is produced between the cleaning cloth structure and the surface to be cleaned, so as to achieve deep cleaning.

In actual implementation, the main control circuit board can control the power of the main motor 104 according to different cleaning scenarios, and further flexibly adjust the suction force between the chuck 108 and the surface to be cleaned, so as to meet the cleaning requirements of different scenarios. For example, for a tile surface to be cleaned and a glass surface to be cleaned, the main control circuit board can control the power of the main motor 104 according to the surface to be cleaned of different materials, and further adjust the suction force between the chuck 108 and the surface to be cleaned.

The edge wheel motor drives, through the edge wheel worm, the cleaning cloth structure to rotate, so as to achieve the purpose of wiping the surface to be cleaned. The above described cleaning machine is provided with three sets of the edge wheel driving structures distributed in a form of a triangle. By the main control circuit board controlling the rotation time and the rotation angle of the edge wheel motors in the three sets of the edge wheel driving structures, the movement of the cleaning machine, e.g., advancing, turning, etc., can be achieved, and during the movement of the cleaning machine, thorough cleaning of the surface to be cleaned is achieved.

In the cleaning machine provided in an embodiment of the present application, at least one group including the main motor and the fan blade unit matching with each other is arranged between the upper housing and the middle housing; three groups each including edge wheel motor, edge wheel gear set and edge wheel worm are distributed in a form of a triangle between the middle housing and the lower housing; a chuck and a cleaning cloth structure are arranged outside of the lower housing; the main motor draws, through the fan blade unit, air from between the chuck and a surface to be cleaned, with the chuck attached to the surface to be cleaned; the edge wheel motor drives, through the edge wheel gear set, the cleaning cloth structure to rotate, such that friction is generated between the cleaning cloth structure and the surface to be cleaned, so as to clean the surface to be cleaned. In this configuration, the main motor can adjust the pressure between the cleaning cloth structure and the surface to be cleaned, in order to meet the demands of various cleaning angles and cleaning depths; and the edge wheel motors distributed in a form of a triangle can drive the cleaning machine to move, and simultaneously cause friction between the cleaning cloth structure and the surface to be cleaned, enabling the completion of the cleaning task in the moving process, with better and more thorough cleaning effects and better user experience.

Optionally, one group including a main motor 104 and a fan blade unit 105 matching with each other is arranged between the upper housing 101 and the middle housing 102. As shown in FIG. 1, the main motor 104 and the fan blade unit 105 are arranged at a central position of the three sets of the edge wheel driving structures. In the present embodiment, air between the three chucks and the surface to be cleaned can simultaneously be drawn by one group including the main motor and the fan blade unit, and this generally requires that the main motor has a relatively high power, in order to meet the requirement of suction force between the cleaning machine and the surface to be cleaned. Thus, in the present embodiment, it is also feasible to arrange multiple groups each including the main motor and the fan blade unit. Then the multiple groups each including the main motor and the fan blade unit are arranged to draw air from between the three chucks and the surface to be cleaned.

It should be noted that, in the present embodiment, if multiple groups each including the main motor and the fan blade unit are arranged, in one implementation, air, between the chuck at the bottom of each set of the edge wheel driving structures and the surface to be cleaned, can be drawn by the multiple groups each including the main motor and the fan blade unit; and in another implementation, the air, between the chuck at the bottom of each set of the edge wheel driving structures and the surface to be cleaned, can be drawn by at least one of the multiple groups each including the main motor and the fan blade unit. Specifically, the working state of each of the multiple groups each including the main motor and the fan blade unit may be set according to actual demands, which is not specifically defined in the present embodiment.

Compared with the arrangement of multiple groups each including the main motor and the fan blade unit, the arrangement of one group including the main motor and the fan blade unit enables simpler mechanical structure and circuit structure. Consequently, the overall performance of the cleaning machine is more stable, and the weight and volume of the cleaning machine are reduced, which makes it easy to carry and move the cleaning machine, and at the time of performing cleaning, the cleaning machine bears a smaller load and is therefore more energy-saving.

On the basis of the above described structure in which one group including the main motor and the fan blade unit is provided, as shown in FIG. 1, the main control circuit board 106 is a ring-shaped circuit board arranged between the upper housing 101 and the middle housing 102; and as can be seen from FIG. 1, the ring-shaped circuit board surrounds the periphery of the fan blade unit.

The inner diameter of the ring-shaped main control circuit board is matched with the outer diameter of the fan blade unit. By means of this configuration, it is possible to nest the fan blade unit within the ring-shaped main control circuit board. Consequently, the ring-shaped main control circuit board will be more stable on one hand, and on the other hand, due to such a nested manner, the main control circuit board will not hinder the fan blade unit from drawing air from the chuck, such that the chuck 108 has a greater suction force and becomes more stable.

Optionally, referring to the structural exploded view of another cleaning machine in FIG. 3, three groups each including a main motor 104 and a fan blade unit 105 matching with each other are arranged between the upper housing and the middle housing, and the three groups each including the main motor and the fan blade unit correspond to the three sets of the edge wheel driving structures in the vertical direction, respectively.

As shown in FIG. 3, each group including the main motor and the fan blade unit is configured to draw air from the chuck at the bottom of the corresponding edge wheel driving structure. This method does not require that each main motor has a relatively high power, as long as the demand of attachment of one chuck is met.

Compared with the arrangement of one group including the main motor and the fan blade unit, the arrangement of three groups each including the main motor and the fan blade unit leads to a relatively great number of parts, which therefore requires that both the main motor and the fan blade unit have relatively small volume and weight, so as to avoid excessively large volume and weight of the cleaning machine. Moreover, the cleaning machine provided with one group including the main motor and the fan blade unit has a smaller height than the cleaning machine provided with three groups each including the main motor and the fan blade unit. Thus, the cleaning machine provided with one group including the main motor and the fan blade unit is more compact and portable and has a smaller weight.

However, compared with the manner of using one group including the main motor and the fan blade unit to control three chucks to generate a suction force, the manner of using three groups each including the main motor and the fan blade unit makes it possible to control the respective chucks to generate different suction forces, which enables more flexible control and generation of a greater suction force.

As shown in FIG. 3, on the basis of the above described structure in which the cleaning machine is provided with three groups each including the main motor and the fan blade unit, the main control circuit board 106 is a Y-type circuit board; the Y-type circuit board is arranged between the middle housing 102 and the lower housing 103, and each of three branches of the Y-type circuit board is positioned between two main motors.

The gaps between the three branches of the Y-type circuit board are matched with the outer diameters of the fan blade units, so that the main control circuit board will not hinder the fan blade units from drawing air for the respective chucks, making the chucks have a greater suction force and more stable.

As shown in FIG. 1 or FIG. 3, the above described main motors each comprise a main motor support 104*a* and a main motor body 104*b*; the main motor body 104*b* is fixed at the bottom of the main motor support 104*a*; the top of the main motor support 104*a* is connected with the upper housing.

Optionally, as shown in FIG. 1 or FIG. 3, the cleaning cloth structure 110 comprises a cleaning cloth support 110*a* and a cleaning cloth 110*b*; three cleaning cloth structures 110 are provided; as can be seen from FIG. 1 or FIG. 3, the cleaning cloth support 110*a* is ring-shaped; the cleaning cloth 110*b* is fixed at the bottom of the chuck 108 by the cleaning cloth support 110*a*.

Before the cleaning machine is started, it is feasible to spray a cleaning liquid onto the cleaning cloth 110*b* or soak the cleaning cloth 110*b* in the cleaning liquid in advance, or directly spray the cleaning liquid onto the surface to be cleaned. In order to ensure the thoroughness of the cleaning by the cleaning machine, the center-to-center distance between two adjacent cleaning cloth supports 110*a* may be set to be the diameter of the cleaning cloth support, so as to avoid leaving out an area not cleaned during the cleaning process.

Optionally, as shown in FIG. 1 or FIG. 3, the cleaning machine further comprises a battery pack 111 arranged within the lower housing and located at a central position of the three sets of the edge wheel driving structures. The battery pack may be rechargeable batteries, e.g., rechargeable storage batteries and lithium batteries, and may also be dry batteries; the battery pack 111 is connected with the main motor, the edge wheel motor and the main control circuit board respectively, for the use of supplying power to the main motor, the edge wheel motor and the main control circuit board.

The rechargeable battery can be rechargeable for a limited number of times, and it needs to be used in cooperation with a charger. The rechargeable battery has the advantages of being economical and environment-friendly, having sufficient electricity and being suitable for the electric appliances with large power and longtime use.

In addition, as shown in FIG. 1 or FIG. 3, a remote control receiving board 112 is further arranged within the lower housing, the remote control receiving board is configured to receive a control signal from a remote controller 113; the remote control receiving board 112 is connected with the main control circuit board 106 and is configured to send the control signal to the main control circuit board 106; the remote controller 113 may be configured to control the turn-on, turn-off, cleaning mode selection, etc. of the cleaning machine.

When the cleaning machine is configured to wipe glass, the cleaning machine can be attached to the glass surface and can wipe the glass of any thickness; moreover, the cleaning machine in the present embodiment has a relatively high wiping speed and requires about 3 minutes to clean one square meter of glass; it has a variety of cleaning directions for selection, and can automatically clean the entire area of the current glass and automatically stop after the wiping has been finished.

It should be noted that, in the present embodiment, the wiping speed of the cleaning machine can further be adjusted. For example, speed mode 1, speed mode 2 and speed mode 3 are set, and the speed mode 1, speed mode 2 and speed mode 3 have successively higher wiping speeds, a user may send through the remote controller 113 to the cleaning machine a selection signal indicating the speed mode, so that the cleaning machine performs wiping in the selected speed mode.

In the present embodiment, within the cleaning machine is further provided an uninterruptible power system/uninterruptible power supply (UPS), and when a power outage occurs, the cleaning machine can still operate for about 20 minutes.

The cleaning machine further has a function of automatically detecting a window frame.

The user can control the operation of the cleaning machine through the remote controller.

In order to avoid accidental dropping, the cleaning machine is further provided with a high-strength safety rope (for example, with a tensile strength of 15 Kgf) and a rope fastener. The cleaning machine may further be provided with a rope fastener on it, and when the cleaning machine is used to clean the glass of high-rise buildings, the high-strength safety rope can further be fixed by this rope fastener. When it is not necessary to use the high-strength safety rope, the high-strength safety rope can be released from the rope fastener.

Refer to the schematic diagram of an external structure of a cleaning machine in FIG. 4 and the schematic diagram of another external structure of a cleaning machine in FIG. 5; as can be known by comparing FIG. 4 with FIG. 5, the height of the cleaning machine (FIG. 4) provided with one group including the main motor and the fan blade unit is slightly smaller than the height of the cleaning machine (FIG. 5) provided with three groups each including the main motor and the fan blade unit. Therefore, it can be known that the cleaning machine with one group including the main motor and the fan blade unit is more compact and portable.

Optionally, the main control circuit board is provided with a wireless communication module connected with an external user terminal. The wireless communication module comprises a WIFI module, or a Bluetooth module, or a Zigbee module, or a wireless radio frequency module or the like.

An APP (application) of the cleaning machine may be installed on the user terminal such as a mobile phone or a smart watch of the user, and by means of the APP, the user can control the turn-on, turn-off, timing, operation mode selection, etc. of the cleaning machine through the user terminal.

Optionally, the cleaning machine further comprises a camera set comprising a plurality of cameras uniformly arranged on the upper housing. The plurality of cameras are connected with the main control circuit board and configured to capture an image of the surface to be cleaned before cleaning and an image of the surface to be cleaned after cleaning and send the images to the main control circuit board.

The main control circuit board is configured to predict, according to the image of the surface to be cleaned before cleaning, an obviously stained area on the surface to be cleaned and control the main motor to increase power when the cleaning machine moves to the obviously stained area.

The plurality of cameras are used for detecting an image within their image capturing range thereof and sending the image to the main control circuit board. At this time, the main control circuit board can predict a stained area on the surface to be cleaned according to the obtained image and controls the main motor to increase power when the cleaning machine moves to the stained area.

Since the obviously stained area may be difficult to clean, the cleaning machine can increase the suction force of the chuck with respect to the surface to be cleaned by increasing the power of the main motor, so as to increase the friction force between the cleaning cloth and the surface to be cleaned, thereby cleaning the obviously stained area.

The main control circuit board is further used to determine whether the obviously stained area has disappeared after cleaning, based on the image of the surface to be cleaned; if not, the main control circuit board controls the cleaning machine to return to the obviously stained area along the original path for repeated cleaning.

For example, the cameras distributed ahead of the cleaning machine in its advancing direction may be configured to acquire an image of the surface to be cleaned before cleaning, and the cameras distributed behind the cleaning machine in its advancing direction may be configured to acquire an image of the surface to be cleaned after cleaning.

In one optional embodiment, the main control circuit board can control the cleaning machine to return to the obviously stained area along the original path for repeated cleaning. In another optional embodiment, if the original path is blocked, the main control circuit board can also control the cleaning machine to return to the obviously stained area along a different path for the repeated cleaning, in which the said different path may be the shortest path from the cleaning machine to the obviously stained area. These are not specifically defined in the present embodiment.

In the present embodiment, the main control circuit board can determine whether the obviously stained area has disappeared in the following manner:

The main control circuit board may make image comparison between an image of an obviously stained area before cleaning and an image of the obviously stained area after cleaning; if the image of the obviously stained area after cleaning has changed greatly and the image of the area is similar to the image of its surroundings, it indicates that the obviously stained area has disappeared, and then the cleaning machine continues to advance; if the image of the obviously stained area after cleaning has not changed greatly and the image of the area still greatly differs from the image of its surroundings, it indicates that the obviously stained area has not disappeared, and then the cleaning machine returns to the obviously stained area along the original path to repeatedly clean the area until the obviously stained area disappears.

The cameras can be classified into two types, i.e., digital cameras and analog cameras. The digital camera can convert an analog video signal generated by a video acquisition device into a digital signal, and then store the same. The video signal captured by the analog camera must be subjected to a particular video capturing card by which the analog signal is converted into its digital mode and compressed, in order to be used by the controller.

The digital camera can directly capture images, and then transmit the same to the controller through serial or parallel ports, or USB interfaces. Among the digital cameras, most of them are USB digital cameras using a novel data transmission interface.

Resolution, generally denoted as dpi (dot per inch), is a parameter for measuring the data quantity of the bitmap image. The resolution of a camera refers to the ability of the camera to resolve images, i.e., the number of pixels of an image sensor of the camera. The highest resolution refers to the highest image discerning ability of a camera, i.e., the biggest number of pixels of the camera.

Many existing 300,000-pixel CMOS have a resolution of 640×480, and 500,000-pixel CMOS have a resolution of 800×600. The two numbers of a resolution represent the numbers of dots occupied by the length and the width of an image, and a length-to-width ratio of a digital image is typically 4:3.

Optionally, the above described cleaning machine further comprises a laser ranging radar arranged on the upper housing. The laser ranging radar is connected with the main control circuit board and configured to detect the edge positions of the surface to be cleaned and send the edge positions to the main control circuit board.

In the present embodiment, at least one laser ranging radar can be arranged on the cleaning machine. When at least one laser ranging radar are provided, the plurality of laser ranging radars can be uniformly distributed on the upper housing of the cleaning machine.

The main control circuit board is further configured to plan a path for the cleaning machine according to the edge positions. For example, when the cleaning machine sweeps the floor, the laser ranging radar is configured to detect the edge positions of the floor; and when the cleaning machine cleans the glass, the laser ranging radar is configured to detect the edge positions of the frame of the glass. When the edge positions of the surface to be cleaned are detected, the main control circuit board can plan a path for the cleaning machine according to the edge positions.

The laser ranging radar is a radar system emitting a laser beam to detect the feature, such as position and velocity, of a target. There is no fundamental difference between the laser ranging radar and a microwave radar in terms of working principle, i.e., transmitting a detection signal (a laser beam) to a target, and then comparing the received signal (target echo wave), reflected from the target, with the transmitted signal and appropriately processing the received signal, obtaining related information of the target, e.g., the parameters of the target, such as the distance, orientation, height, velocity, posture, and even shape, so as to detect, track and identify the target.

By means of the laser ranging radar, the cleaning machine can sense the information of the surrounding environment for navigation, obstacle avoidance and performing a cleaning task. The laser ranging radar not only needs a field of view large enough to cover the entire working area, but also requires a relatively high acquisition rate to ensure the providing of real-time information in a changing environment.

The cleaning machine further comprises an infrared sensor arranged at the bottom of the lower housing. At least one infrared sensors are provided, and the plurality of infrared sensors are uniformly distributed at the edge positions of the bottom of the lower housing. The plurality of infrared sensors are connected with the main control circuit board and configured to acquire vertical distances between the surface to be cleaned and positions of the infrared sensors and sends the distances to the main control circuit board; the main control circuit board is used for changing the path of the cleaning machine when the distances are greater than a preset threshold.

If there are multiple infrared sensors, then multiple distances will be acquired; the main control circuit board is used for changing the path of the cleaning machine when N distances among the multiple distances are greater than the preset threshold, where N is a positive integer greater than zero and N can be set according to the actual demands, which is not specifically defined in the present embodiment.

The infrared sensor can measure the distances between the surface to be cleaned and positions of the infrared sensors, so as to prevent the cleaning machine from falling off the surface to be cleaned and damaging the surface to be cleaned when the cleaning machine moves to the edge of the surface to be cleaned, thereby improving the self-protection ability of the cleaning machine.

The cleaning machine further comprises a loudspeaker arranged on the upper housing. The loudspeaker is connected with the main control circuit board and configured to play the audio data sent by the main control circuit board. For example, the relevant audio data prompts the user that the cleaning by the cleaning machine has been finished, that a malfunction occurs in the cleaning machine, that the cleaning machine is stuck, etc.

Corresponding to the cleaning machine, an embodiment of the present application provides a path control method for a cleaning machine, the method being applied to the cleaning machine; refer to the schematic diagram of a movement path for a cleaning machine in FIG. 6 and the schematic diagram of another movement path for a cleaning machine in FIG. 7; the cleaning machine comprises a first edge wheel gear set (wheel set A) (e.g., wheel set A in FIG. 6 and FIG. 7), a second edge wheel gear set (wheel set B) (e.g., wheel set B in FIG. 6 and FIG. 7) and a third edge wheel gear set (wheel set C) (e.g., wheel set C in FIG. 6 and FIG. 7); the method comprising the steps of:

step 11: making, in an advancing direction of the cleaning machine, the second edge wheel gear set (wheel set B) and the third edge wheel gear set (wheel set C) located in front of the first edge wheel gear set (wheel set A); making a connection line between the second edge wheel gear set (wheel set B) and the third edge wheel gear set (wheel set C) perpendicular to the advancing direction;

step 12: executing, after the cleaning machine is started, straight-line movement instructions of: commanding the first edge wheel gear set (wheel set A) and the second edge wheel gear set (wheel set B) to simultaneously rotate clockwise by a first preset angle; and commanding the first edge wheel gear set (wheel set A) and the third edge wheel gear set (wheel set C) to simultaneously rotate counterclockwise by the first preset angle; specifically the straight-line movement instructions are continuously executed until a turning instruction is received;

alternatively, executing straight-line movement instructions of: commanding the first edge wheel gear set (wheel set A) and the second edge wheel gear set (wheel set B) to simultaneously rotate counterclockwise by a first preset angle; and commanding the first edge wheel gear set (wheel set A) and the third edge wheel gear set (wheel set C) to simultaneously rotate clockwise by the first preset angle; specifically, the straight-line movement instructions are continuously executed until a turning instruction is received;

alternatively, executing straight-line movement instructions of: commanding the first edge wheel gear set (wheel set A) to be fixed, and the second edge wheel gear set (wheel set B) and the third edge wheel gear set (wheel set C) to simultaneously rotate clockwise by a first preset angle; commanding the third edge wheel gear set (wheel set C) to be fixed, and the first edge wheel gear set (wheel set A) and the second edge wheel gear set (wheel set B) to simultaneously rotate clockwise by the first preset angle; and commanding the second edge wheel gear set (wheel set B) to be fixed and the first edge wheel gear set (wheel set A) and the third edge wheel gear set (wheel set C) to simultaneously rotate clockwise by the first preset angle;

alternatively, executing straight-line movement instructions of: commanding the first edge wheel gear set (wheel set A) to be fixed, and the second edge wheel gear set (wheel set B) and the third edge wheel gear set (wheel set C) to simultaneously rotate counterclockwise by a first preset angle; commanding the third edge wheel gear set (wheel set C) to be fixed, and the first edge wheel gear set (wheel set A) and the second edge wheel gear set (wheel set B) to simultaneously rotate counterclockwise by the first preset angle; and commanding the second edge wheel gear set (wheel set B) to be fixed and the first edge wheel gear set (wheel set A) and the third edge wheel gear set (wheel set C) to simultaneously rotate counterclockwise by the first preset angle.

As shown in FIG. 6, after the cleaning machine is started, firstly, the wheel set A and the wheel set B are controlled to simultaneously rotate (of course, it is also feasible that the wheel set A and the wheel set C simultaneously rotate first). During the rotation, the wheel sets rotate clockwise by the first preset angle, and the first preset angle can be set according to the radius of the wheel set and may be any angle in the range of 0-360 degrees as long as the wheel sets are enabled to move forward by a reasonable distance. For example, the angle may be 45 degrees; after the rotation, the wheel set A and the wheel set C are controlled to rotate simultaneously, and during the rotation, the wheel sets rotate counterclockwise by the first preset angle; at the moment, the relative position of the wheel set A, the wheel set B and the wheel set C is restored to the position before the starting of the cleaning machine; at the moment, then the wheel set A and the wheel set B are controlled to rotate.

Refer to the schematic diagram of another movement path for a cleaning machine in FIG. 10; the wheel set A is fixed, and the wheel set B and the wheel set C simultaneously rotate clockwise by the first preset angle, and the first preset angle can be set according to the radius of the wheel set and may be any angle in the range of 0-360 degrees as long as the wheel sets are enabled to move forward by a reasonable distance and the preset turning angle is realized. For example, the optional angle may be 120 degrees; after the rotation, the wheel set C is controlled to be fixed, and the wheel set A and the wheel set B simultaneously rotate clockwise by the first preset angle; after the rotation, the wheel set B is controlled to be fixed, and the wheel set A and the wheel set C simultaneously rotate clockwise by the first preset angle; refer to the schematic diagram of another movement path for a cleaning machine in FIG. 11; in FIG. 11, all the wheel sets rotate counterclockwise, and the other rotation manners are the same as those in FIG. 10.

Step 13: executing, after a turning instruction is received, turning operations of: commanding the first edge wheel gear set (wheel set A) and the second edge wheel gear set (wheel set B) to simultaneously rotate clockwise by a second preset angle, or commanding the first edge wheel gear set (wheel set A) and the third edge wheel gear set (wheel set C) to simultaneously rotate clockwise by the second preset angle; alternatively, commanding the first edge wheel gear set (wheel set A) and the second edge wheel gear set (wheel set B) to simultaneously rotate counterclockwise by a second preset angle, or commanding the first edge wheel gear set (wheel set A) and the third edge wheel gear set (wheel set C) to simultaneously rotate counterclockwise by the second preset angle; specifically, the second preset angle is greater than the first preset angle.

When the cleaning machine makes a turn, the two wheel sets that are closer to the outer side of the turning need to rotate by a relatively great angle; as shown in FIG. 6, when the cleaning machine turns right, the wheel set A and the wheel set B are the wheel sets that are closer to the outer side of the turning, and the wheel set A and the wheel set B simultaneously rotate clockwise by the second preset angle which may be twice the first preset angle, equivalent to the wheel set A and the wheel set B rotating by the first preset angle twice, thereby realizing the turning.

Step 14: executing, after a turn-around instruction is received, turn-around operations of: the first edge wheel gear set (wheel set A) and the third edge wheel gear set (wheel set C) to simultaneously rotate clockwise by a first preset angle, in a case where the turn-around instruction is received after the first edge wheel gear set (wheel set A) and the second edge wheel gear set have simultaneously rotated clockwise by the first preset angle; and commanding the first edge wheel gear set (wheel set A) and the second edge wheel gear set (wheel set B) to simultaneously rotate counterclockwise by the first preset angle, in a case where the turn-around instruction is received after the first edge wheel gear set (wheel set A) and the third edge wheel gear set (wheel set C) have simultaneously rotated counterclockwise by the first preset angle.

Refer to the schematic diagram of another movement path for a cleaning machine in FIG. 8 and the schematic diagram of another movement path for a cleaning machine in FIG. 9; the cleaning machine comprises a first edge wheel gear set (e.g., wheel set A in FIG. 8 and FIG. 9), a second edge wheel gear set (e.g., wheel set B in FIG. 8 and FIG. 9) and a third edge wheel gear set (e.g., wheel set C in FIG. 8 and FIG. 9).

If a turn-around instruction is received after the wheel set A and the wheel set C have rotated counterclockwise by the first preset angle, the wheel set A and the wheel set B rotate counterclockwise by the first preset angle, and then the wheel set B and the wheel set C rotate clockwise by the first preset angle; and if a turn-around instruction is received after the wheel set A and the wheel set B have rotated clockwise by the first preset angle, the wheel set A and the wheel set C rotate clockwise by the first preset angle, and then the wheel set A and the wheel set B rotate counterclockwise by the first preset angle.

Generally, the cleaning path of a cleaning machine consists of straight-line movement and turning; for a surface to be cleaned having a certain surface area, the cleaning machine needs to move and perform cleaning along a reasonable path; based on this, the above method further comprises the steps of:

step 21, detecting edge positions of the surface to be cleaned after the cleaning machine is started; for example, the edge positions can be detected by detecting, through a sensor, whether a collision occurs with the housing of the cleaning machine or whether the housing of the cleaning machine partially overhangs;

step 22, moving, along the edge positions of the surface to be cleaned, the cleaning machine by half of a perimeter of the surface to be cleaned; and step 23, moving the cleaning machine along a zigzag path, so that the cleaning machine cleans the surface to be cleaned, in which the zigzag path includes straight-line paths and turning paths; and a distance between adjacent straight-line paths is smaller than a coverage width of the cleaning machine obtained when the cleaning machine performs cleaning along the straight-line paths.

Optionally, when the surface to be cleaned is rectangular, the cleaning machine starts from a first vertex angle, moves along the edge of the rectangle by one length side and one width side of the rectangle and arrives at the opposite vertex angle of the first vertex angle, and starting from the opposite vertex angle, the cleaning machine begins to move along a zigzag path and finally returns to the first vertex angle, thereby finishing the task of cleaning the current surface to be cleaned.

For example, when the surface to be cleaned is rectangular, the cleaning machine can start from one vertex angle P of the rectangle, and then the cleaning machine moves along the edge of the rectangle by one length side and one width side of the rectangle, and finally moves to the opposite vertex angle Q of the vertex angle P. At this time, the cleaning machine can move from the vertex angle Q along a zigzag path and finally move to the vertex angle P, so as to finish the task of cleaning the current surface to be cleaned.

Optionally, when the surface to be cleaned is rectangular, the cleaning machine starts from the first vertex angle (the lower left angle), moves along the edge of the rectangle by one length, one width side and one length side of the rectangle, and arrives at the lower right angle of the surface to be cleaned, and then starting from the lower right angle, the cleaning machine moves along a zigzag path and finally returns to the first vertex angle, so as to finish the task of cleaning the current surface to be cleaned.

As shown in FIG. 6, in the zigzag path, the straight-line path is the segment MN and the turning path is segment NT; the distance between adjacent straight-line paths is equal to the length of the turning path; in order to ensure thorough and complete cleaning, the distance between adjacent straight-line paths is smaller than the coverage width of the cleaning machine when the cleaning machine moves along the straight-line path, so as to avoid leaving out an area not cleaned.

In FIG. 6, it can be considered that the cleaning machine starts from the lower left corner of the surface to be cleaned; in FIG. 7, it can be considered that the cleaning machine starts from the lower right corner of the surface to be cleaned; of course, the cleaning machine can also start from the upper left corner, the upper right corner, or other positions of the surface to be cleaned, and the specific position is not defined in the present embodiment.

As shown in FIG. 8 and FIG. 9, the cleaning machine only moves along a zigzag path so as to clean the surface to be cleaned. In FIG. 8, it can be considered that the cleaning machine starts from the lower left corner of the surface to be cleaned; in FIG. 9, it can be considered that the cleaning machine starts from the lower right corner of the surface to be cleaned; of course, the cleaning machine can also start from the upper left corner, the upper right corner, or other positions of the surface to be cleaned, and the optional positions are not defined in the present embodiment. The paths shown in FIG. 12 and FIG. 13 show the manners in which the cleaning machines shown in FIG. 10 and FIG. 11 perform cleaning along a zigzag path when making straight-line movement.

In the path control method for a cleaning machine provided by an embodiment of the present application, when the cleaning machine makes a straight-line movement, the first edge wheel gear set and the second edge wheel gear set, as well as the first edge wheel gear set and the third edge wheel gear set alternately rotate by a first preset angle; when the cleaning machine makes a turn, the first edge wheel gear set and the second edge wheel gear set, or the first edge wheel gear set and the third edge wheel gear set simultaneously rotate clockwise by a second preset angle; in this way, the cleaning machine can move along a zigzag path, so as to finish the task of cleaning the surface to be cleaned, with better and more thorough cleaning effect and better user experience.

The implementation principles and the produced technical effects of the path control method for a cleaning machine provided by the embodiments of the present application are the same as those set forth in the embodiments of the cleaning machine, and for the ease of description, as to the contents not mentioned in the embodiments of the method, reference can be made to the corresponding contents in the embodiments of the cleaning machine.

The main motor provided in the embodiments of the present application, which can also be referred to as motor, a device converting electric energy into mechanical energy, converts electric energy into mechanical energy. It essentially comprises an electromagnetic winding or a distributed stator winding, and a rotating armature or a rotor, for generating a magnetic field. A rotating magnetic field is generated by means of electrified coils and further acts on the rotor to form a rotation torque of magneto-electric power. Motors can be classified, by the type of the power supply used, into direct current motors and alternating current motors. The motors in the power system are mostly alternating current motors, which may be either synchronous motors or asynchronous motors.

The main control circuit board provided by the embodiments of the present application optionally may comprise a memory and a processor, in which the memory is configured to store one or more computer instructions, and the one or more computer instructions are executed by the processor.

Optionally, the main control circuit board further comprises a bus and a communication interface, and the processor, the communication interface and the memory are connected through the bus.

The flow diagram and the block diagram in the drawings show the system architectures, functions and operations that may be implemented according to the system, method and computer program product in the embodiments of the present application. In this regard, each box in the flow diagram or block diagram may represent a module, a program segment or some of the codes, comprising one or more executable instructions configured to implement a specified logical function. It should also be noted that in some alternative implementations, the functions noted in the box can also occur in the order different from the order indicated in the drawings. For example, two consecutive boxes actually can be executed substantially in parallel, or they may sometimes be executed in the reverse order, which is determined according to the functions involved. It should further be noted that each box in the block diagram and/or the flow diagram, and a combination of the boxes in the block diagram and/or the flow diagram can be implemented by a special hardware-based system for executing specified functions or actions, or can be implemented by a combination of special hardware and computer instructions.

The cleaning machine and the computer program product of the path control method therefor provided by the embodiments of the present application include a computer-readable storage medium which stores program codes. The instructions included in the program codes can be used for executing the methods set forth in the above method embodiments. As for the specific implementation, reference can be made to the method embodiments, and no further description is made herein.

In addition, in the description of the embodiments of the present application, unless otherwise explicitly specified and defined, the terms such as "install", "link" and "connect" shall be understood broadly, which may, for example, refer to fixed connection, detachable connection or integral connection; may refer to mechanical connection or electrical connection; may refer to direct connection or indirect connection by means of an intermediate medium, and may refer to communication between two elements. Those of ordinary skills in the art could understand the specific meaning of the terms in the present application according to specific situations.

When implemented in the form of software functional units and sold or used as independent products, the functions can be stored in a computer readable storage medium. Based on such understanding, the part of the essence of the technical solution of the present application, or the part of the technical solution of the present application that makes contributions to the prior art, or part of the technical solution can be embodied in the form of a software product, and the computer software product is stored in a storage medium, comprising some instructions for enabling one computer device (which can be a personal computer, a server, a network device or the like) to execute all or some of the steps of the methods in the embodiments of the present application. The storage medium includes various mediums capable of storing program codes, such as a USB flash drive, a mobile hard disk, a read-only memory (ROM), a random access memory (RAM), a magnetic disk, or an optical disk.

In the description of the present application, it is to be understood that the orientation or position relation denoted by the terms such as "center", "upper", "lower", "left", "right", "vertical", "horizontal", "inner" and "outer" is based on the orientation or position relation indicated by the figures, which only serves to facilitate describing the present application and simplify the description, rather than indicating or suggesting that the device or element referred to must have a particular orientation, and is constructed and operated in a particular orientation, and therefore cannot be construed as a limitation on the present application. In addition, the terms such as "first", "second" and "third" only serve the purpose of description and cannot be understood as an indication or implication of relative importance.

Finally, it should be noted that the above embodiments are merely optional embodiments of the present application, which are only used to illustrate the technical solutions of the present application, rather than limit the same, and the scope of protection of the present application is not limited thereto. Although the present application has been described in detail with reference to the above embodiments, it should be understood by those of ordinary skills in the art that, within the technical scope disclosed by the present application, those skilled in the art can still modify the technical solutions disclosed in the embodiments, or readily conceive variations of these technical solutions, or make equivalent substitution for some of the technical features therein; however, these modifications, variations or substitutions will not cause the essence of the corresponding technical solutions to depart from the spirit and scope of the technical solutions of the embodiments of the present application, and shall all be covered by the protection scope of the present application. Therefore, the scope of protection of the present application shall be determined by the scope of protection of the appended claims.

The advantageous effects of the embodiments of the present application include:

In the cleaning machine provided in an embodiment of the present application, at least one group including the main motor and the fan blade unit matching with each other is arranged between the upper housing and the middle housing; three groups each including the edge wheel motor, the edge wheel gear set and the edge wheel worm are distributed in a form of a triangle between the middle housing and the lower housing; a chuck and cleaning cloth structure are arranged outside of the lower housing, the main motor draws, through the fan blade unit, air from between the chuck and a surface to be cleaned, with the chuck attached to the surface to be cleaned; the edge wheel motor drives, through the edge wheel gear set, the cleaning cloth structure to rotate, such that friction is generated between the cleaning cloth structure and the surface to be cleaned, so as to clean the surface to be cleaned. In this configuration, the main motor can adjust the pressure between the cleaning cloth structure and the surface to be cleaned, in order to meet the demands of various cleaning angles and cleaning depths; and the edge wheel motors distributed in a form of a triangle can drive the cleaning machine to move, and simultaneously cause friction between the cleaning cloth structure and the surface to be cleaned, enabling the completion of the cleaning task in the moving process, with better and more thorough cleaning effects and better user experience.

In the path control method for a cleaning machine provided by an embodiment of the present application, when the cleaning machine makes a straight-line movement, the first edge wheel gear set and the second edge wheel gear set, as well as the first edge wheel gear set and the third edge wheel gear set alternately rotate by a first preset angle; when the cleaning machine makes a turn, the first edge wheel gear set and the second edge wheel gear set, or the first edge wheel gear set and the third edge wheel gear set simultaneously rotate clockwise or counterclockwise by a second preset angle; in this way, the cleaning machine can move along a zigzag path, so as to finish the task of cleaning the surface to be cleaned, with better and more thorough cleaning effect and better user experience.

INDUSTRIAL APPLICABILITY

The embodiments of the present application provide a cleaning machine and a path control method for the cleaning machine; in the method, the main motor can adjust the pressure between the cleaning cloth structure and the surface to be cleaned, so as to meet the demands of various cleaning angles and cleaning depths; the edge wheel motors distributed in a form of a triangle can drive the cleaning machine to move and at the same time drive the cleaning cloth structure to wipe the surface to be cleaned, so as to complete the cleaning task in the moving process, with better and more thorough cleaning effects and better user experience.

The invention claimed is:

1. A cleaning machine, wherein the cleaning machine comprises an upper housing, a middle housing and a lower housing, at least one group including a main motor and a fan blade unit matching with each other is arranged between the upper housing and the middle housing, the fan blade unit is fixedly at a bottom of the main motor, and a main control circuit board is arranged at a bottom of the fan blade unit;

three sets of edge wheel driving structures are distributed in a form of a triangle between the middle housing and the lower housing, each set of the edge wheel driving structures comprises an edge wheel motor, an edge wheel gear set and an edge wheel worm, an output shaft of the edge wheel motor is fixedly connected with the edge wheel worm, the edge wheel worm is engaged with the edge wheel gear set; a chuck and a cleaning cloth structure are arranged outside of the lower housing, the chuck is in fluid communication with the fan blade unit, and the cleaning cloth structure is connected with the edge wheel gear set; and the main control circuit board is configured to control turn-on or turn-off of the main motor and the edge wheel motor; wherein when the main motor is turned on, the main motor is configured to draw, through the fan blade unit, air from between the chuck and a surface to be cleaned, with the chuck attached to the surface to be cleaned; and wherein when the edge wheel motor is turned on, the edge wheel motor is configured to drive, through the edge wheel gear set, the cleaning cloth structure to rotate, so that friction is generated between the cleaning cloth structure and the surface to be cleaned, thereby cleaning the surface to be cleaned, wherein one group including the main motor and the fan blade unit matching with each other is arranged between the upper housing and the middle housing;

the main motor and the fan blade unit are arranged at a central position of the three sets of the edge wheel driving structures, the main control circuit board is a ring-shaped circuit board;

the ring-shaped circuit board is arranged between the upper housing and the middle housing; and the ring-shaped circuit board surrounds a periphery of the fan blade unit, or three groups each including the main motor and the fan blade unit matching with each other are arranged between the upper housing and the middle housing, the three groups each including the main motor and the fan blade unit correspond to the three sets of the edge wheel driving structures in a vertical direction respectively the main control circuit board is a Y-type circuit board; and the Y-type circuit board is arranged between the middle housing and the lower housing, and each of three branches of the Y-type circuit board is positioned between two of the main motors.

2. The cleaning machine according to claim 1, wherein the cleaning machine provided with one group including the main motor and the fan blade unit has a smaller height than the cleaning machine provided with three groups each including the main motor and the fan blade unit.

3. The cleaning machine according to claim 1, wherein the main motor comprises a main motor support and a main motor body; and the main motor body is fixed at a bottom of the main motor support and a top of the main motor support is connected with the upper housing.

4. A path control method for a cleaning machine, wherein the method is applicable for the cleaning machine of claim 1, the cleaning machine comprises a first edge wheel gear set, a second edge wheel gear set and a third edge wheel gear set, the method comprises:

making, in an advancing direction of the cleaning machine, the second edge wheel gear set and the third edge wheel gear set located in front of the first edge wheel gear set, and making a connection line between the second edge wheel gear set and the third edge wheel gear set perpendicular to the advancing direction;

executing, after the cleaning machine is started, straight-line movement instructions of: commanding the first edge wheel gear set and the second edge wheel gear set to simultaneously rotate clockwise by a first preset angle, and commanding the first edge wheel gear set and the third edge wheel gear set to simultaneously rotate counterclockwise by the first preset angle, wherein the straight-line movement instructions are continuously executed until a turning instruction is received; alternatively, executing straight-line movement instructions of: commanding the first edge wheel gear set and the second edge wheel gear set to simultaneously rotate counterclockwise by a first preset angle, and commanding the first edge wheel gear set and the third edge wheel gear set to simultaneously rotate clockwise by the first preset angle, wherein the straight-line movement instructions are continuously executed until a turning instruction is received; alternatively, executing straight-line movement instructions of: commanding the first edge wheel gear set to be fixed and the second edge wheel gear set and the third edge wheel gear set to simultaneously rotate clockwise by a first preset angle, commanding the third edge wheel gear set to be fixed and the first edge wheel gear set and the second edge wheel gear set to simultaneously rotate clockwise by the first preset angle, and commanding the second edge wheel gear set to be fixed and the first edge wheel gear set and the third edge wheel gear set to simultaneously rotate clockwise by the first preset angle; alternatively, executing straight-line movement instructions of: commanding the first edge wheel gear set to be fixed and the second edge wheel gear set and the third edge wheel gear set to simultaneously rotate counterclockwise by a first preset angle, commanding the third edge wheel gear set to be fixed and the first edge wheel gear set and the second edge wheel gear set to simultaneously rotate counterclockwise by the first preset angle, and commanding the second edge wheel gear set to be fixed and the first edge wheel gear set and the third edge wheel gear set to simultaneously rotate counterclockwise by the first preset angle;

executing, after the turning instruction is received, turning operations of: commanding the first edge wheel gear set and the second edge wheel gear set to simultaneously rotate clockwise by a second preset angle, or commanding the first edge wheel gear set and the third edge wheel gear set to simultaneously rotate clockwise by the second preset angle; alternatively, commanding the first edge wheel gear set and the second edge wheel gear set to simultaneously rotate counterclockwise by a second preset angle, or commanding the first edge wheel gear set and the third edge wheel gear set to simultaneously rotate counterclockwise, by the second preset angle, wherein the second preset angle is greater than the first preset angle;

executing, after a turn-around instruction is received, turn-around operations of: commanding the first edge wheel gear set and the third edge wheel gear set to simultaneously rotate clockwise by the first preset angle, in a case where the turn-around instruction is received after the first edge wheel gear set and the second edge wheel gear set have simultaneously rotated clockwise by the first preset angle; and commanding the first edge wheel gear set and the second edge wheel gear set to simultaneously rotate counterclockwise by the first preset angle, in a case where the turn-around instruction is received after the first edge wheel gear set and the third edge wheel gear set have simultaneously rotated counterclockwise by the first preset angle;

detecting edge positions of the surface to be cleaned after the cleaning machine is started;

moving, along the edge positions of the surface to be cleaned, the cleaning machine by half of a perimeter of the surface to be cleaned; and moving the cleaning machine along a zigzag path, so that the cleaning machine cleans the surface to be cleaned, wherein the zigzag path includes straight-line paths and turning paths, and a distance between adjacent straight-line paths is smaller than a coverage width of the cleaning machine obtained when the cleaning machine performs cleaning along the straight-line paths.

5. The method according to claim 4, wherein one group including the main motor and the fan blade unit matching with each other is arranged between the upper housing and the middle housing; and the main motor and the fan blade unit are arranged at the central position of the three sets of the edge wheel driving structures.

6. The method according to claim 5, wherein the main control circuit board is a ring-shaped circuit board;

the ring-shaped circuit board is arranged between the upper housing and the middle housing; and the ring-shaped circuit board surrounds a periphery of the fan blade unit.

7. The method according to claim 4, wherein three groups each including the main motor and the fan blade unit matching with each other are arranged between the upper housing and the middle housing; and the three groups each including the main motor and the fan blade unit correspond to the three sets of the edge wheel driving structures in a vertical direction, respectively.

8. The method according to claim 7, wherein the cleaning machine provided with one group including the main motor and the fan blade unit has a smaller height than the cleaning machine provided with three groups each including the main motor and the fan blade unit.

9. The method according to claim 7, wherein the main control circuit board is a Y-type circuit board; and the Y-type circuit board is arranged between the middle housing and the lower housing, and each of three branches of the Y-type circuit board is positioned between two of the main motors.

* * * * *